US007524385B2

(12) United States Patent
McGrath

(10) Patent No.: US 7,524,385 B2
(45) Date of Patent: Apr. 28, 2009

(54) CONTROLLED PHASE TRANSITION OF METALS

(75) Inventor: Terrence S. McGrath, Longmont, CO (US)

(73) Assignee: Elemetric, LLC, Longmont, CO (US)

( * ) Notice: Subject to any disclaimer, the term of this patent is extended or adjusted under 35 U.S.C. 154(b) by 238 days.

(21) Appl. No.: 11/542,431

(22) Filed: Oct. 3, 2006

(65) Prior Publication Data

US 2008/0078481 A1 Apr. 3, 2008

(51) Int. Cl.
*C21D 10/00* (2006.01)

(52) U.S. Cl. ..... 148/558; 148/565

(58) Field of Classification Search ..... 148/565
See application file for complete search history.

(56) References Cited

U.S. PATENT DOCUMENTS

| | | | | |
|---|---|---|---|---|
| 2,972,695 | A | 2/1961 | Wroe | |
| 4,048,459 | A | 9/1977 | Earle | |
| 4,609,564 | A | 9/1986 | Pinkhasov | |
| 4,645,895 | A | 2/1987 | Boxman et al. | |
| 4,849,088 | A | 7/1989 | Veltrop et al. | |
| 5,014,769 | A | 5/1991 | El-Kaddah et al. | |
| 5,037,522 | A | 8/1991 | Vergason | |
| 5,095,479 | A * | 3/1992 | Harigaya et al. | 369/288 |
| 5,269,898 | A | 12/1993 | Welty | |
| 5,895,559 | A | 4/1999 | Christy | |
| 6,797,401 | B2 | 9/2004 | Herron | |
| 6,936,145 | B2 | 8/2005 | Sunthankar et al. | |
| 6,968,718 | B2 | 11/2005 | Imamura | |
| 7,214,280 | B2 * | 5/2007 | Kumar et al. | 148/525 |
| 2004/0238366 | A1 | 12/2004 | Vladimirovich et al. | |
| 2005/0064110 | A1 | 3/2005 | Van Westrum et al. | |

FOREIGN PATENT DOCUMENTS

| | | |
|---|---|---|
| EP | 1380364 B1 | 1/2004 |
| JP | 05230777 | 9/1993 |
| KR | 10-2205-0097579 | 10/2005 |
| WO | WO 2006/102224 A2 | 9/2006 |

OTHER PUBLICATIONS

Warren, S. C. et al. "Generalized Route to Metal Nanoparticles with Liquid Behavior" *J. Am. Chem. Soc.*, 2006, pp. 12074-12075, vol. 128.

"Editor's Choice," *Science*, Sep. 15, 2006, p. 1542, vol. 313.

* cited by examiner

*Primary Examiner*—George Wyszomierski
(74) *Attorney, Agent, or Firm*—Saliwanchik, Lloyd & Saliwanchik

(57) ABSTRACT

A process for electromagnetic (EM) energy-induced solid to liquid phase transitions in metals is disclosed. The method utilizes coherent EM fields to transform solid materials such as silicon and aluminum without significant detectable heat generation. The transformed material reverts to a solid form after the EM field is removed within a period of time dependent on the material and the irradiation conditions.

9 Claims, 4 Drawing Sheets

CONTROLLED PHASE TRANSITION OF METALS

BACKGROUND OF THE INVENTION

1. Field of the Invention

The invention relates generally to the field of physical chemistry and particularly to the use of electromagnetic fields to control solid/liquid phase transitions in metals.

2. Description of Background Art

Electromagnetic (EM) fields are used in several practical applications, including motors and radio wave transmissions. An EM field is considered to be a unique force different from the forces organizing gravity, particle mass and elemental charge. The relation of electromagnetism in terms of structure to rest mass and inertial mass has yet to be fully understood, perhaps explaining why electromagnetic applications are fairly limited and have not been applied to the development of new mechanical and medical uses.

A major shortcoming of conventional descriptions of EM fields is the tendency to look at field generation as 2-dimensional around current flowing around a wire. Current theory views EM fields as generating a horn torus structure associated with a donut with no hole, and having a positive charge on one side of the torus and a negative charge on the other side. The causal mechanism for such a field structure is not understood. This has provided little insight with respect to EM wave interactions and the possibility of controlling the forces associated with magnetic field generation and chemical bond control within the atom.

Measurement of field and field strength has been accomplished most often by using "flat" measuring devices; i.e., devices oriented along a single plane. Flat measuring devices, for example, are used to measure nuances in the earth's magnetic field; however, such devices only give a single orientation to either north or south poles or provide only the general strength of the EM field. The causal structure of chiral fields and mechanisms for control have yet to be defined or understood.

Phase transitions of metals, for example a solid to liquid transition, generally employ heat energy to cause the bond disruption that leads to a phase transition. For most metals, heat and significant energy input are required to transition from the solid to the liquid state.

Metal forming processes are important in many industries and, while sometimes employing mechanical manipulation, most currently require high heat or caustic chemicals for processing. Chromium, for example, requires either extreme temperatures exceeding 1910° C. or, for electrodeposited plating processes, the use of a highly toxic hexavalent chrome solution. Energy expenditure with either process is considerable, with over 90% of energy input being wasted as heat.

Currently used processes for melting aluminum employ low-efficiency (~30%) gas furnaces. Approximately 67 trillion Btu (TBtu) are consumed to melt and hold the 32 billion pounds of molten aluminum annually in the United States to produce ingots, sheets, plates, extrusions and castings. Use of gas furnaces alone requires ~2,100 Btu/lb simply to melt the aluminum.

Deficiencies in the Art

Despite progress in developing energy efficient methods, particularly in metal processing, current technologies have yet to harness electromagnetic energy for controlling liquid/solid phase transitions. By selectively targeting and disrupting chemical bonds, significant economic advantages can be realized by reducing energy losses in the form of heat.

SUMMARY OF THE INVENTION

The present invention is an electromagnetic (EM) processing method for rapidly transforming metals with a minimal amount of energy lost as heat. The transition is achieved by directing coherent magnetic fields such that metal bonding is disrupted. High temperatures are not required and the EM field energy can be tuned to effect a phase change in a wide range of metals, including alloys and combinations of metals. Many metal transitions can be achieved at or below 50° C. with little or no generation of heat in the process.

Use of a coherent disruptive electromagnetic field makes it possible to direct the energy necessary to disrupt molecular bonding. The disclosed method tunes coherent electromagnetic fields to initiate phase transitions by targeting bond energies so precisely that little heat is generated. By tuning input energy to one or more bond energies of a metal, phase transitions can be accomplished with far less energy lost as heat than is typically the case when solid metals undergo a phase change.

The disclosed method is generally applicable to metals, including, for example, aluminum, copper, tin, iron, titanium and iridium. It is also applicable to those metals that are not generally considered as having typical metal properties, or "metalloids" which act both as metals and nonmetals. The term "metalloid" is used to designate this class of elements, typified by silicon and boron; however, as used herein, it is understood that the term "metal" or "metals" includes metalloids.

Phase transitions within the scope of the invention include at least solid to liquid and liquid to solid transitions. While transitions from the solid to the liquid form are illustrated with several metals, tuning of appropriate input energy to bond energies of a metal in liquid form is expected to convert a liquid to the solid phase; e.g. for mercury. Similarly, other phase transitions are contemplated, such as solid to vapor, vapor to solid, and the like by targeting appropriate bond energies to strengthen or weaken bonds.

The invention therefore is a process for effecting a phase transition in a metal by directing a coherent electromagnetic field adjusted to at least one bond energy frequency of the metal onto the metal. Bond energy frequency information is available from a variety of sources and can be selected from published tables of frequencies for a selected metal. The field generating apparatus for producing any one or more of a selected frequency is readily constructed and the selected frequency can be generated by appropriate choice of power and target material.

A pulsed frequency of about 300 Hz appears to be generally effective for causing solid/liquid phase transitions for at least one group of metals, exemplified by aluminum, silicon and steel. It is believed that this frequency is one of several that can induce this type of phase transition and that additional frequencies can be identified that will speed or slow the phase transition and that will be preferable for other phase transitions such as liquid to solid or solid to vapor.

Definitions

Collimated beams consist of electromagnetic waves which are all progressing in the same direction A laser beam or a synchrotron x-ray beam are considered "well collimated" due to the mechanism by which the EM radiation is produced.

A coherent electromagnetic field is produced when all waves in a beam are in-phase, i.e., have the same phase angle (peaks of waves coincide in space). Waves which are not coherent can interfere with each other, leading to a reduction of the intensity. As used in this application, a coherent electromagnetic field is understood to inherently include a collimated beam.

DETAILED DESCRIPTION OF THE INVENTION

Figure 1A:
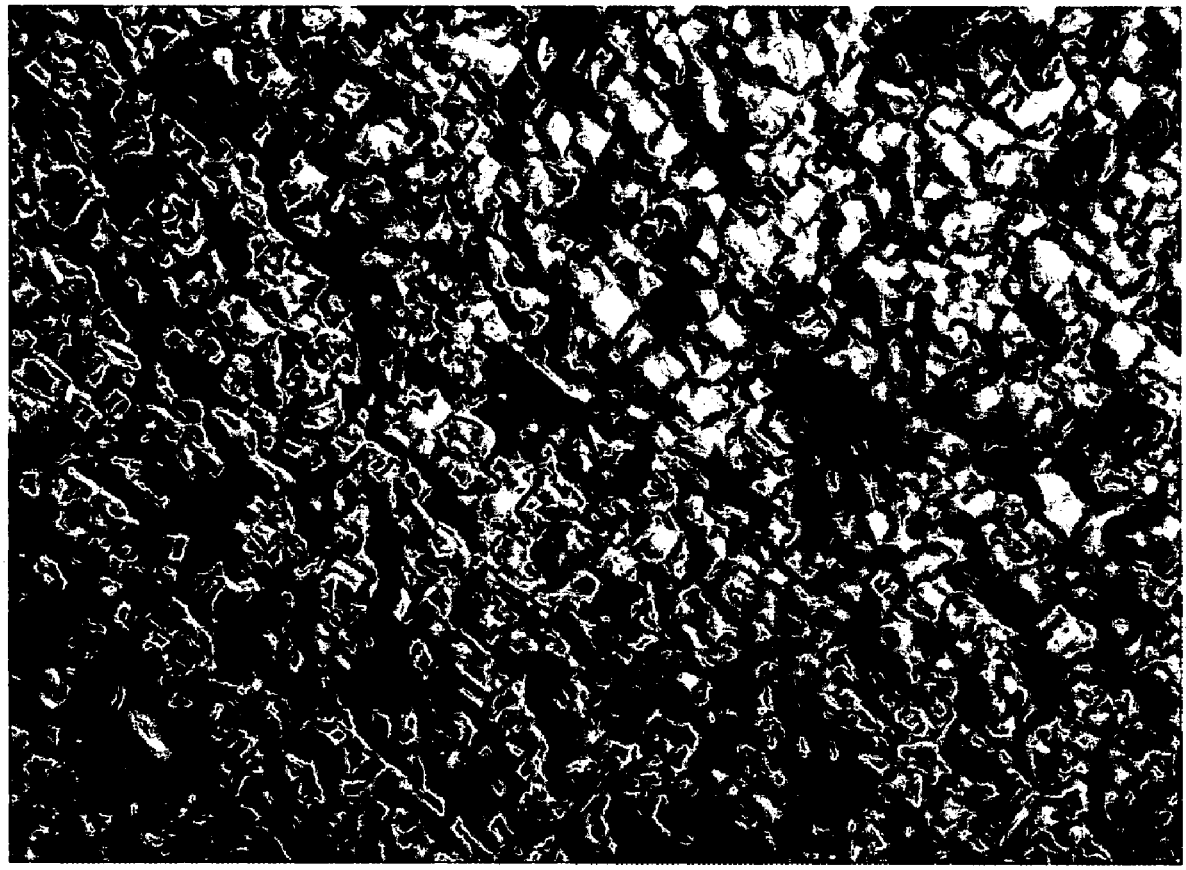
FIG. 1A is a 40-fold magnification of the surface of the wafer before exposure to a bond-disrupting electromagnetic field.

The present invention provides a method for using magnetic fields to create coherent electromagnetic radiation that disrupts bond energies in metals. Multiple magnetic fields are produced at a determined distance from the metal surface using power levels appropriate for the particular metal for which a phase transition is desired. The electromagnetic fields applied are tuned to the precise energy required to disrupt a metal bond.

Control of a solid to liquid transition has been demonstrated with several metals, including silicon, a metalloid, which exhibits both metal and non-metal properties. Silicon is used in semiconductors, but has only one prevalent crystalline form and is less metallic than its congeners, germanium, tin and lead. Silicon normally melts at approximately 1400° C., but exhibits flowing (transition from solid form) near 40° C. when exposed to appropriate coherent electromagnetic fields as disclosed in the procedures set forth herein. After exposure to a coherent EM field, silicon reverts to a solid form.

Elemental boron, similar to silicon, also has properties borderline between metals and nonmetals. Like silicon, it is a semiconductor, not a metallic conductor, and chemically resembles silicon more than its metallic congeners, thallium, gallium and indium. Boron exhibits several crystal structures, each allotrope having different stabilities, but all known forms melt at or well above 1000° C. It is expected that this element will resolidify using procedures similar to those used for the described phase transition for silicon.

Aluminum, while considered a metal, exhibits both ionic and nonionic character. It melts around 660° C. and is recognized as a hard, strong and white metal. Exposure of aluminum to a coherent EM field under the described conditions readily initiated a phase transition, causing the solid to liquefy within about 10 sec. Solidification occurred when the electromagnetic field was removed.

The strength of a chemical bond is defined as the standard enthalpy change of the reaction in which the bond M-X is broken to form the two component atoms, M and X. Values shown in Table 1 refer to the bond strengths of the gaseous diatomic species MX. By customizing electromagnetic field frequencies to a particular element, and to the intended phase desired, it is believed that virtually any transition can be efficiently achieved with minimal energy input.

TABLE 1

| Bond Energy Enthalpies in gaseous diatomic species | |
|---|---|
| SiSi | 326.8 ± 10.0 kJ $mol^{-1}$ |
| AlAl | 133 ± 6 kJ $mol^{-1}$ |
| CrCr | 142.9 ± 5.4 kJ $mol^{-1}$ |
| CuCu | 176.52 ± 2.38 kJ $mol^{-1}$ |
| PbPb | 86.6 ± 0.8 kJ $mol^{-1}$ |
| NiNi | 203.26 ± 0.96 kJ $mol^{-1}$ |
| AuAu | 224.7 ± 1.5 kJ $mol^{-1}$ |
| NbNb | 510.00 ± 10.0 kJ $mol^{-1}$ |
| FeFe | 75 ± 17 kJ $mol^{-1}$ |
| OO | 498.36 ± 0.17 kJ $mol^{-1}$ |

EXAMPLES

The following examples are provided as illustrations of the invention and are in no way to be considered limiting.

Example 1

Apparatus for Generating Electromagnetic Field

A vacuum chamber was constructed of ⅜" thick A6 steel with a diameter of 30 in and a length of 36 in. The chamber was pumped with a VHS 6 oil diffusion pump with 400 ml of DuPont 704 diffusion pump oil. The pump was backed by a 30 CFM Pfeiffer mechanical pump with 1 liter of Stokes C-77 pump oil. The chamber was rough pumped by a Leybold E-75 pump with a WU 500 blower package with Fomblin oil. The pump down of the chamber was controlled by internally designed circuits utilizing an MKS 636 baratron and a BP ion gauge. The apparatus includes a 6×1×20 in, 99.99% pure nickel target with water cooling and two power inputs. This cathode was driven by a Miller 304 CC/CV power supply and a Miller analog pulsing unit.

An alternative to the 6×20 in target cathode are small round target cathodes with a surface diameter of 1 to 6 in. This target configuration can assist in the localization of the transfer of current from the cathode to the anode. Less mechanical setup of the cathode in order to localize the transfer spot will be required. The same physical settings for power may be used in this configuration; 300 Hz, 2 ms pulse, 300 amps and 75 amp background.

Example 2

Electromagnetic Field Induced Phase Transition of Aluminum

Aluminum was selected as the substrate. The pulse current generated by the electromagnetic field using the apparatus described in Example 1 was 300 Hz. Localization of the current outflow from the cathode to the anode in the pulsed mode must be locally confined. At the reported powers, the area of electron flow was confined consistently to an area approximately 3 inches in diameter. This confinement allows creation of a coherent beam in which the EM field travels.

An 8×¼×12 in 6061T6 aluminum plate was placed in an aluminum 2×2×¼ in wall thickness square channel of conductive aluminum that was 22 in tall. This placed the substrate 8 in from the surface of the target. The apparatus was constructed as described in Example 1 and the chamber was pumped to a level of 5E-4 Torr. The power supply was set to 300 amps, 20 V output. The pulsing unit was set with at background current of 75 amps, a pulse width of 2 ms, and a frequency of 300 Hz.

Figure 2:
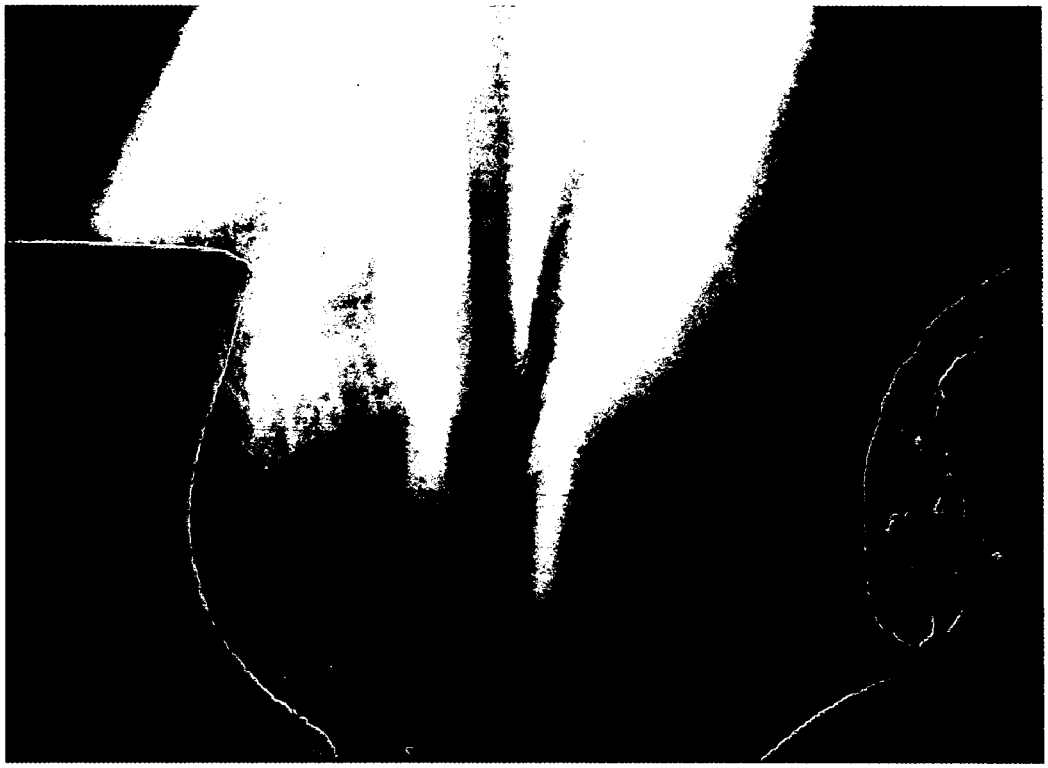
FIG. 2 shows an aluminum plate after exposure to a coherent electromagnetic field under the conditions in Example 2.
Figure 3:
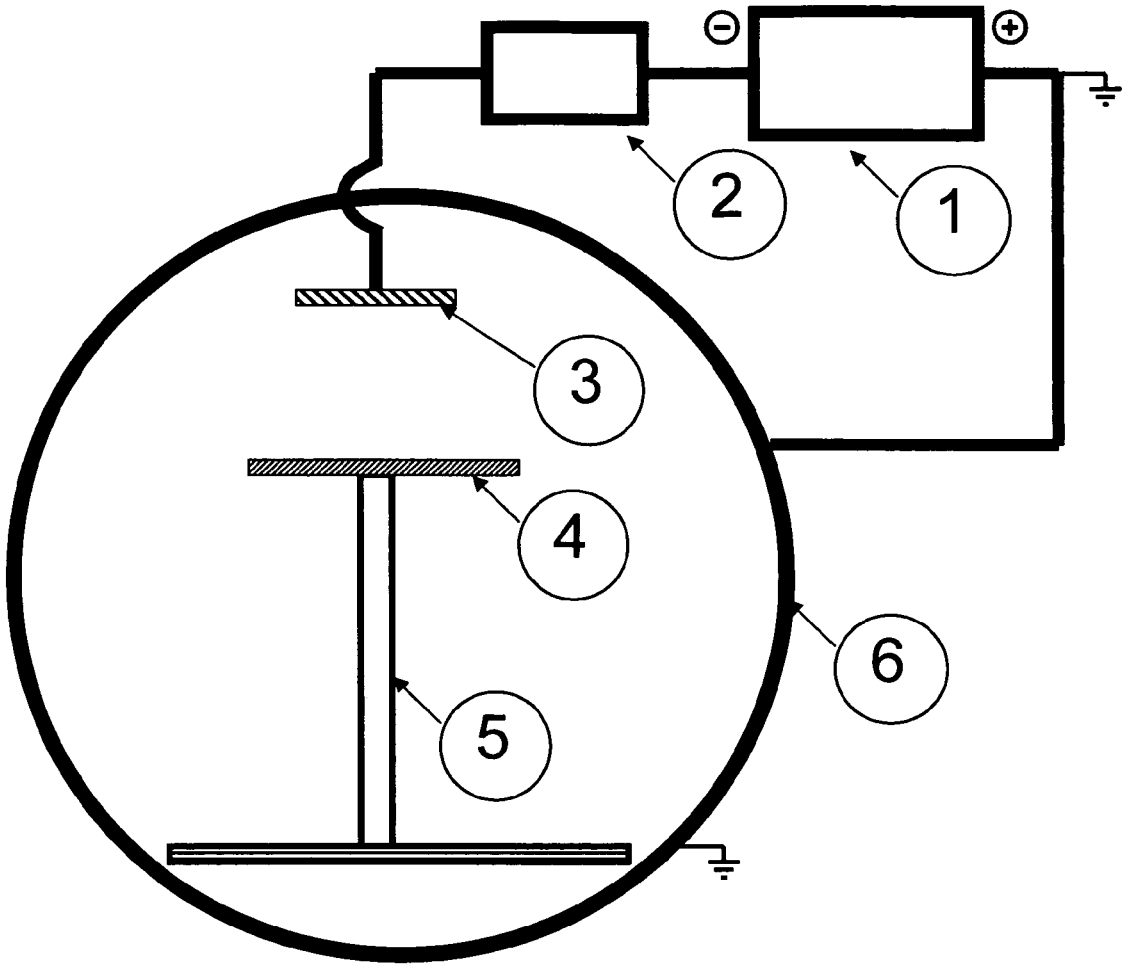
FIG. 3 shows a typical electromagnetic field device that focuses the appropriate energy on a selected material: power supply (1); pulsing unit (2); target (3); substrate (4); conductive substrate support (5); vacuum chamber (6).

The system was initiated through a momentary grounding of the target and allowed to run for approximately 15 seconds. After this time, the power was shut off and the chamber was brought to atmospheric pressure. The aluminum substrate puddled at the bottom of the chamber at a temperature of approximately 30° C. Solidification occurred over a period of 7 days following removal of the electromagnetic field. The temperature of the metal was about 39° C. immediately after the solid began to form. FIG. 2 is a photograph of the resolidified aluminum plate, showing deformation of the metal.

The phase change consumed 0.05 kW-h/kg. Melting the same amount of material is calculated to require 1.354 kW-h/kg which is at least an order of magnitude greater amount of heat energy required to melt aluminum at 661° C. The results showed that only a small fraction of input energy, about 1/27 of the amount of heat required to melt the metal, initiated a solid to liquid phase transition using this method.

Example 3

Electromagnetic Field Induced Phase Transition of Silicon

Figure 1B:
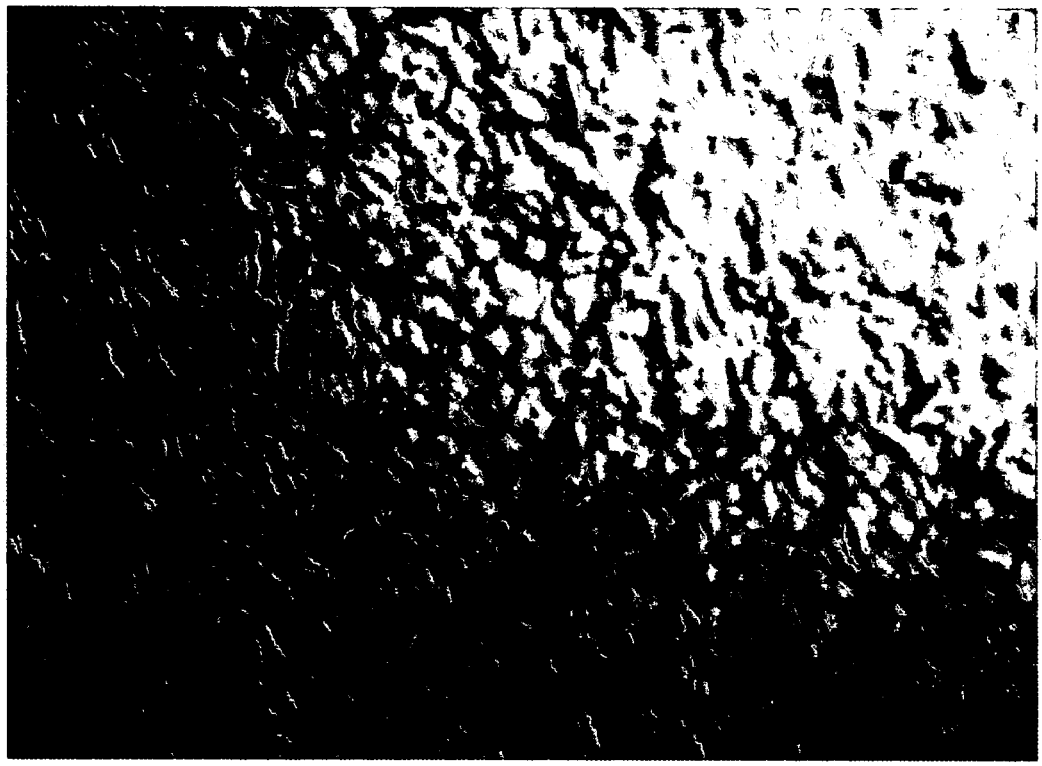
FIG. 1B is a 40-fold magnification of the shows surface of the wafer in FIG. 1A after exposure to a bond-disrupting electromagnetic field.

A 3-inch diameter silicon wafer on a 8×¼×12 in copper plate was placed on an aluminum 2×2×¼ in wall thickness square channel that was 28 in tall. The plate was placed 8 in from the surface of the target. The silicon disk was placed on top of the copper plate, smooth side up in the chamber of the apparatus described in Example 1 using the conditions identical to those described in Example 2. The silicon began to flow at 39° C., which is significantly lower than heat-induced melting, which requires a temperature of 1414° C. FIGS. 1A and 1B compare a 40× magnified surface of the silicon wafer pre- and post treatment.

The rough side of the silicon disc changed from a single crystal to a polycrystalline surface with visual evidence of liquefied flow. The obvious pattern of the original crystal structure was no longer apparent. The originally flat copper substrate plate was warped by several millimeters. The melting point of copper is 1085° C., which is significantly higher than the 39° C. temperature at which these changes were observed.

Example 3

Electromagnetic Field Induced Phase Transition of Steel

A steel plate was placed 3 feet from the target and exposed to a coherently focused electromagnetic beam for 10 s to 2 min using the apparatus described in Example 1 under the conditions set forth in Example 2. The metal began to flow at 200° C., which is significantly lower than heat-induced melting, which requires a temperature of 1515° C.

What is claimed is:

1. A process for producing a solid/liquid phase transition in a metal, comprising;

adjusting one or more coherent electromagnetic (EM) fields generated in a vacuum from a metal target to a frequency of one or more bond energies of a selected metal; and directing the one or more EM fields to the selected metal surface;

wherein the selected metal undergoes transition to a liquid phase without significant generation of heat.

2. The process of claim 1 wherein the transition further comprises a transition of the liquid phase to a vapor phase.

3. The process of claim 1 wherein the selected metal comprises steel.

4. The process of claim 1 wherein the frequency is about 300 Hz.

5. The process of claim 4 wherein the frequency is a pulsed frequency.

6. The process of claim 5 wherein the pulsed frequency is about 2 milliseconds.

7. The process of claim 1 wherein the metal target is a metal selected from the group consisting of nickel, titanium, tungsten, hafnium, chromium, copper, cadmium, iridium, silver, gold and niobium.

8. The process of claim 7 wherein the metal target is nickel.

9. The process of claim 1 wherein the selected metal is aluminum, silicon or steel.

* * * * *

UNITED STATES PATENT AND TRADEMARK OFFICE

CERTIFICATE OF CORRECTION

PATENT NO. : 7,524,385 B2
APPLICATION NO. : 11/542431
DATED : April 28, 2009
INVENTOR(S) : Terrence S. McGrath It is certified that error appears in the above-identified patent and that said Letters Patent is hereby corrected as shown below:

Column 3,
Line 11, "of the shows surface" should read --of the surface--.

Signed and Sealed this

Seventh Day of July, 2009

JOHN DOLL
*Acting Director of the United States Patent and Trademark Office*